US007377491B2

(12) United States Patent
Fuoco

(10) Patent No.: US 7,377,491 B2
(45) Date of Patent: May 27, 2008

(54) TEMPORARY STRUCTURE BRACKET

(76) Inventor: Maurizio Fuoco, 490 Winnett Avenue, Toronto (CA) M6C 2M7

( * ) Notice: Subject to any disclaimer, the term of this patent is extended or adjusted under 35 U.S.C. 154(b) by 0 days.

(21) Appl. No.: 10/905,843

(22) Filed: Jan. 23, 2005

(65) Prior Publication Data

US 2005/0098772 A1 May 12, 2005

Related U.S. Application Data

(63) Continuation of application No. 10/454,573, filed on Jun. 5, 2003, now abandoned.

(51) Int. Cl.
*E04H 17/00* (2006.01)

(52) U.S. Cl. ..... 256/65.03; 256/65.01; 256/65.04; 256/65.14; 256/DIG. 6

(58) Field of Classification Search ..... 256/59, 256/65.01, 68, 69, 65.03–65.05, 65.14, DIG. 5, 256/DIG. 6; 52/298; 248/220.1
See application file for complete search history.

(56) References Cited

U.S. PATENT DOCUMENTS 3,809,346 A 5/1974 Jackson
3,977,147 A 8/1976 Fletcher
4,667,935 A 5/1987 Moore
5,186,430 A 2/1993 Ellithorpe
5,560,588 A 10/1996 Hilliard
5,568,909 A 10/1996 Timko
5,913,508 A 6/1999 Eades
5,946,867 A 9/1999 Snider
6,015,139 A 1/2000 Weber
6,039,150 A 3/2000 Palmer
6,279,880 B1 8/2001 Hawks, Jr.
6,327,830 B1 12/2001 Hecht
6,328,285 B1 12/2001 Wiseman
6,467,230 B1 * 10/2002 Perkins et al. ..... 256/DIG. 6

* cited by examiner

*Primary Examiner*—Robert J. Sandy
*Assistant Examiner*—Victor MacArthur
(74) *Attorney, Agent, or Firm*—Gowan Intellectual Property

(57) ABSTRACT

Disclosed is a construction bracket supporting temporary construction structures such as safety railings and scaffolding which are composed of construction members such as steel or wooden beams. The bracket has a support plate and a substantially hollow column member extending upwardly from the support plate. The column member is provided with at least one aperture adapted to receive a tightening member for securing the construction members to the column member.

11 Claims, 11 Drawing Sheets

TEMPORARY STRUCTURE BRACKET

FIELD OF THE INVENTION

The present invention relates to the art of support brackets and more particularly pertains to a new bracket for use in supporting temporary structures used in the construction industry.

BACKGROUND

The construction of homes and other structures has been a mainstay of the world's economy for many decades. The construction of houses and other structures will often require the erection of temporary structures in order to accomplish construction tasks or to maximize the safety of construction workers.

For example, safety railings are required by many construction codes where a construction worker will be working on a particular horizontal level and no barrier has yet been constructed to prevent the worker from falling to the level or ground below. Such safety railings are composed of sets of vertical posts mounted to gussets and mounting plates. The vertical posts are connected to one another by at least two horizontal railings, one along the ground (the "kick board" or "toe board") and the other a few feet above the ground. Often a midrail will also be attached to the vertical posts between the two other horizontal railings. The safety railings and gussets are usually cut on site and thrown away when the railing is no longer required. As a result, a great deal of wood is used only temporarily on a construction site and then is sent away as waste. This waste of wood is expensive and damaging to the environment.

A number of U.S. patents disclose devices which attempt to make the erection of safety railings simpler and more modular. For example, U.S. Pat. No. 5,560,588 to Hilliard discloses a post base having a central column for receiving a vertical post and ridges which are adapted to receive the kick boards. This device only supports vertical posts and kick boards in a very specific orientation. In addition, the kick boards must be cut to very close tolerances to fit within the ridges if the post base is mounted to the floor before the railings are constructed. Finally, this device is also only useful for safety railings and not other temporary structures.

Accordingly, there is a need for a construction bracket which can be used in the assembly of safety rails and other temporary structures, which can be installed during all phases of the construction process (including after the installation of drywall or after the installation of hardwood flooring) which is flexible enough to allow for multiple lengths of wood and allows for reuse of the wood after the temporary structure is taken down.

SUMMARY OF THE INVENTION

In accordance with one aspect of the present invention, there is provided a construction bracket supporting temporary construction structures composed of construction members. The bracket comprises a support plate and a substantially hollow column member extending upwardly from the support plate. The column member is provided with at least one aperture adapted to receive a tightening member for securing the construction members to the column member.

The support plate may also be provided with securement apertures. In addition the support plate may also be provided with a support plate aperture within the column member.

Optionally, the column member may be provided with a lateral aperture for receiving a construction member mounted generally parallel to the support plate.

The tightener may be at least one threaded bolt when the apertures are provided with internal threads for receiving the at least one threaded bolt.

The column member may also be provided with at least one vertically extending slot.

In another variant of the subject invention, the column member may have a generally rectilinear horizontal cross-section. In addition, the column member may have a front wall, a rear wall and two side walls joining the front wall to the rear wall. The front and rear walls may be provided with corresponding opposed lateral apertures for receiving a construction member through the column member. In addition, the lateral apertures may be disposed towards one of the side walls. Further, at least one of the side walls may be provided with at least one tightening aperture for receiving the tightening member.

In a further variant of the present invention, the centerpoint of the support platemay be laterally displaced from the centerpoint about which the column member is mounted.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION

The novel features which are believed to be characteristic of the present invention, as to its structure, organization, use and method of operation, together with further objectives and advantages thereof, will be better understood from the following discussion.

FIGS. 1 through 5 show a construction bracket 10 in accordance with the present invention. Construction bracket 10 is a bracket designed to support temporary construction structures (such as safety rails, scaffolding etc.) which are composed construction members (such as wooden beams, steel members etc.). Construction bracket 10 is composed of a base plate 20 and a support column 22 affixed thereto.

Figure 1:
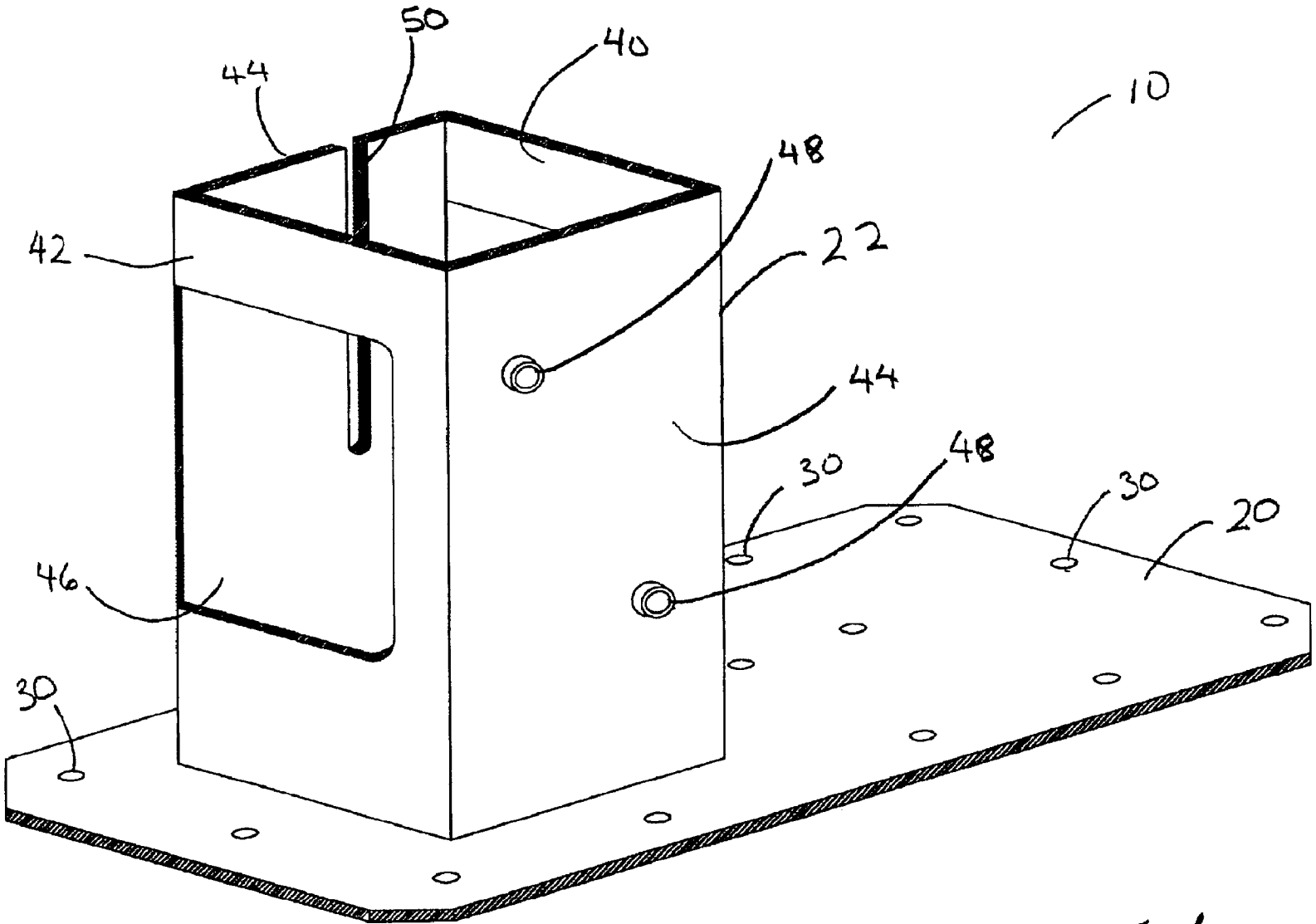
FIG. 1 is a perspective view of a construction bracket in accordance with the present invention.
Figure 2:
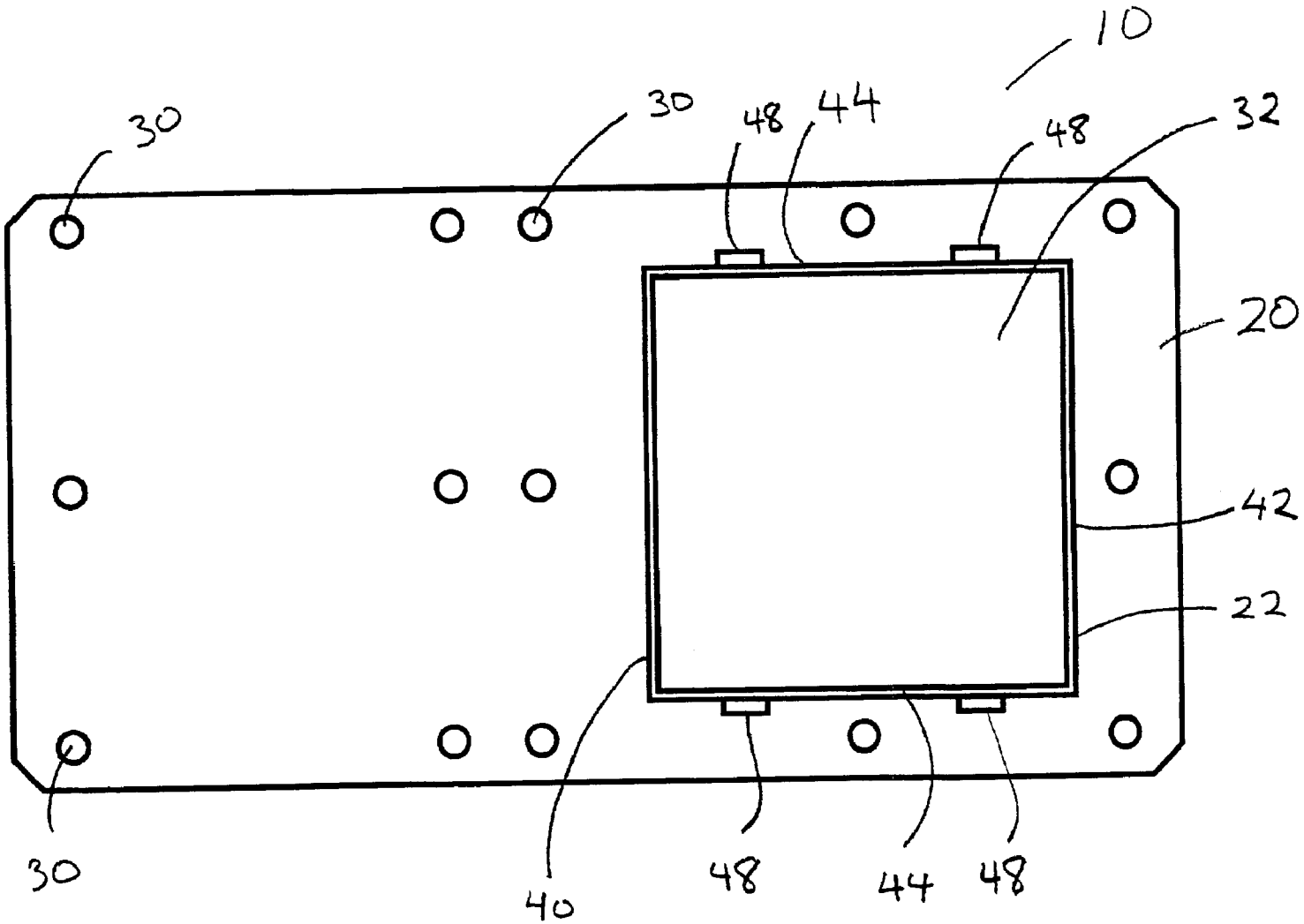
FIG. 2 is a top plan view of a construction bracket generally in accordance with FIG. 1.

As shown in FIG. 2, support plate or base plate 20 is a generally flat, rectangular member. Base plate 20 is provided with a number of securement apertures 30 distributed across the plate. Base plate 20 is also provided with a larger square or rectangular columnar aperture 32 disposed towards one end of base plate 20 (i.e. the centerpoint of columnar aperture 32 is spaced from the centerpoint of base plate 20).

Support column 22 is a generally hollow rectilinear body having four wall members connected at right angles. The wall members include front face 40, rear face 42 and side faces 44. The wall members extend upwardly from base plate 20 and surround columnar aperture 32.

Figure 3:
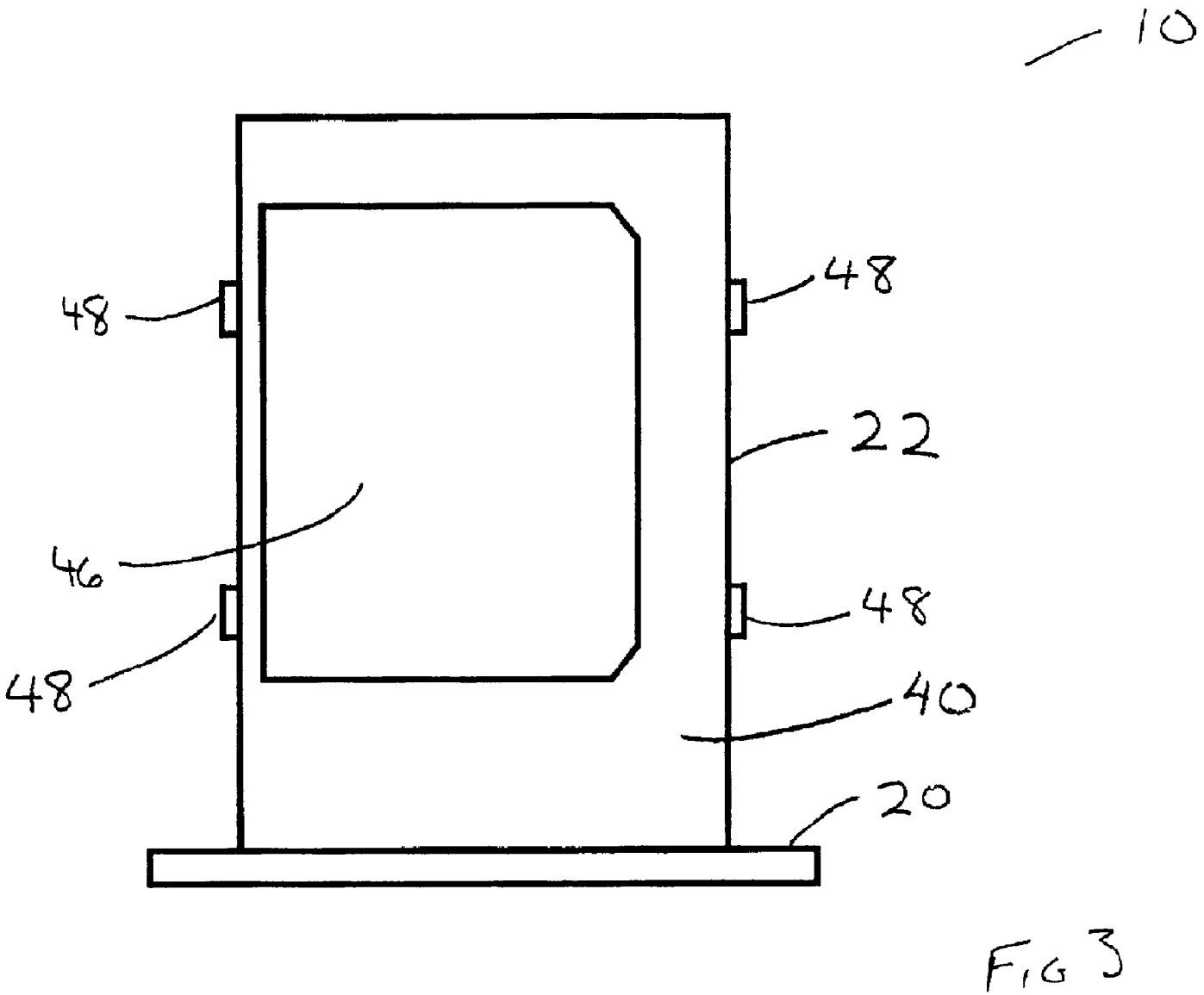
FIG. 3 is a front plan view of a construction bracket generally in accordance with FIG. 1.

As shown in FIG. 3, front face 40 and rear face 42 are provided with matching generally rectangular lateral apertures 46. Lateral apertures 46 are preferably positioned near the vertical center of each of front face 40 and rear face 42 and disposed towards one of side faces 44.

Figure 4:
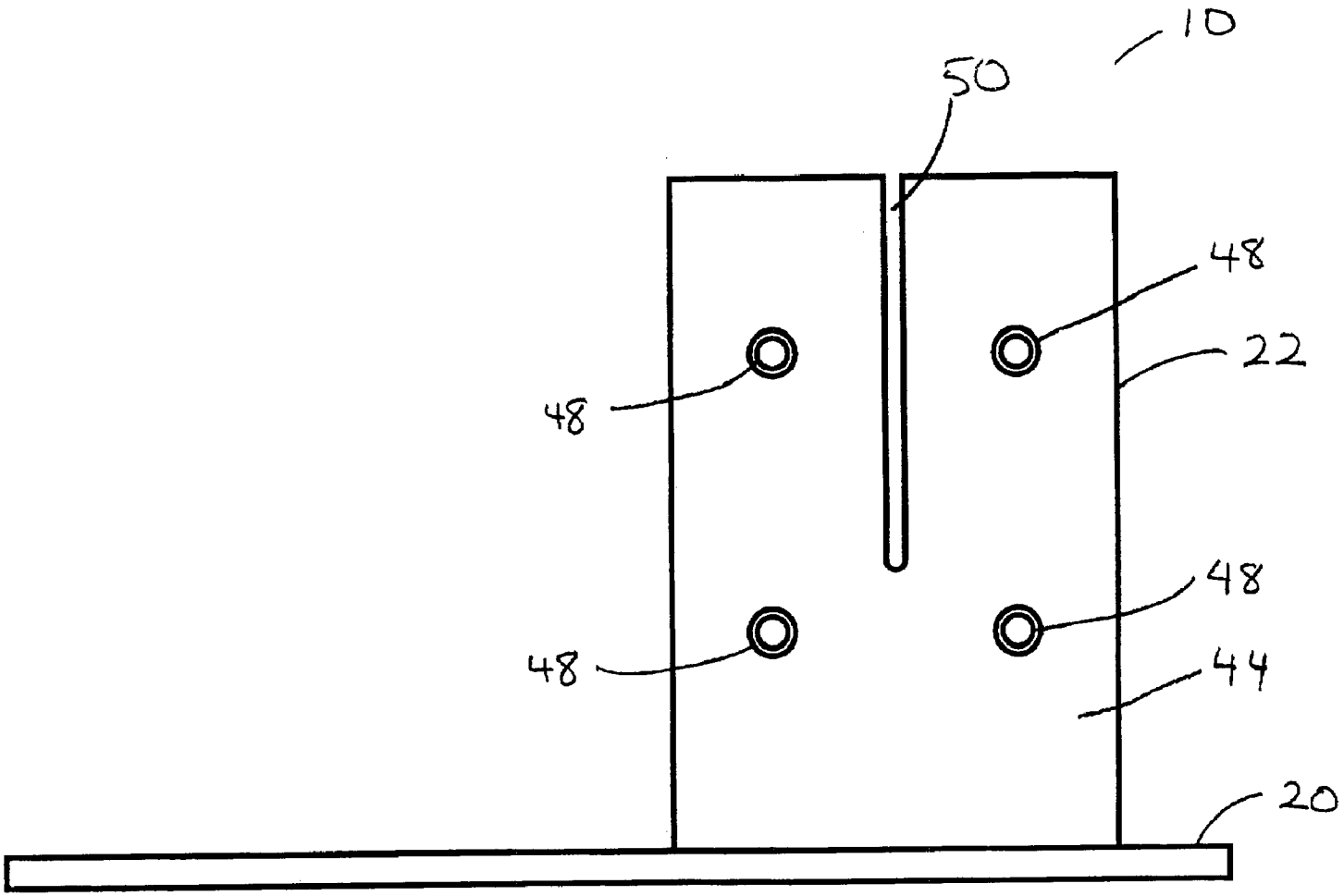
FIG. 4 is a side plan view of a construction bracket generally in accordance with FIG. 1.

As shown in FIG. 4, side faces 44 have four tightening apertures 48 distributed across the face. Tightening apertures 48 are preferably provided with internal threading to receive threaded bolts. Tightening apertures 48 may preferably be provided by weldnuts, or tapped protrusions on side faces 44. As shown in FIG. 4, one or both of side faces 44 may be provided with an optional slot 50 extending downwardly from the upper edge of side face 44.

Figure 5:
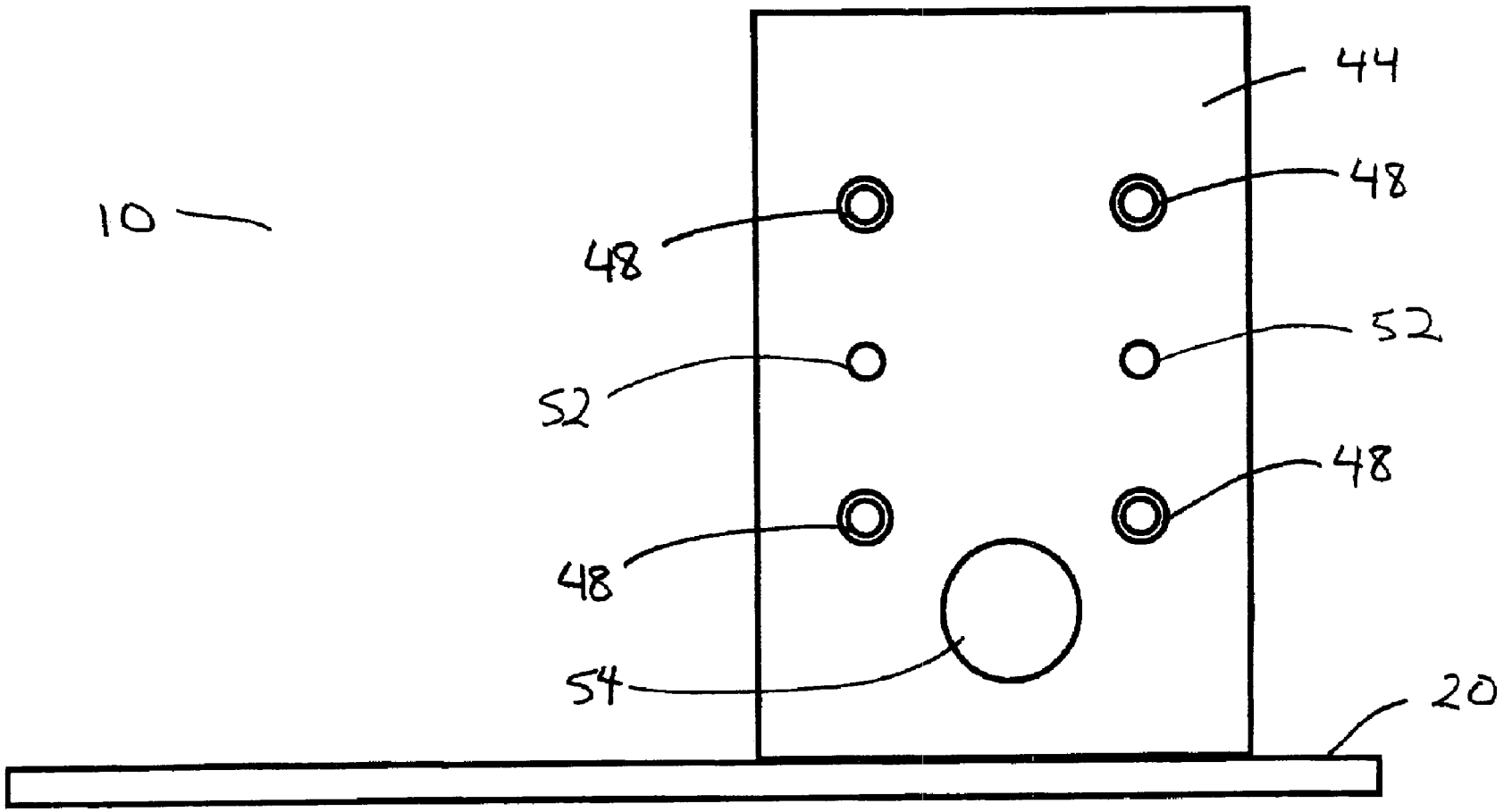
FIG. 5 is a side plan view of another embodiment of a construction bracket in accordance with the present invention.

A variant of the configuration of side faces 44 is shown in FIG. 5. In this variant, side face 44 may be provided with a pair of secondary apertures 52 placed between upper and lower tightening apertures 48. Secondary apertures 52 are suitable for receiving nails or screws which are driven inwardly. In addition, side face 44 may also be provided with a central lower aperture 54.

Figure 6:
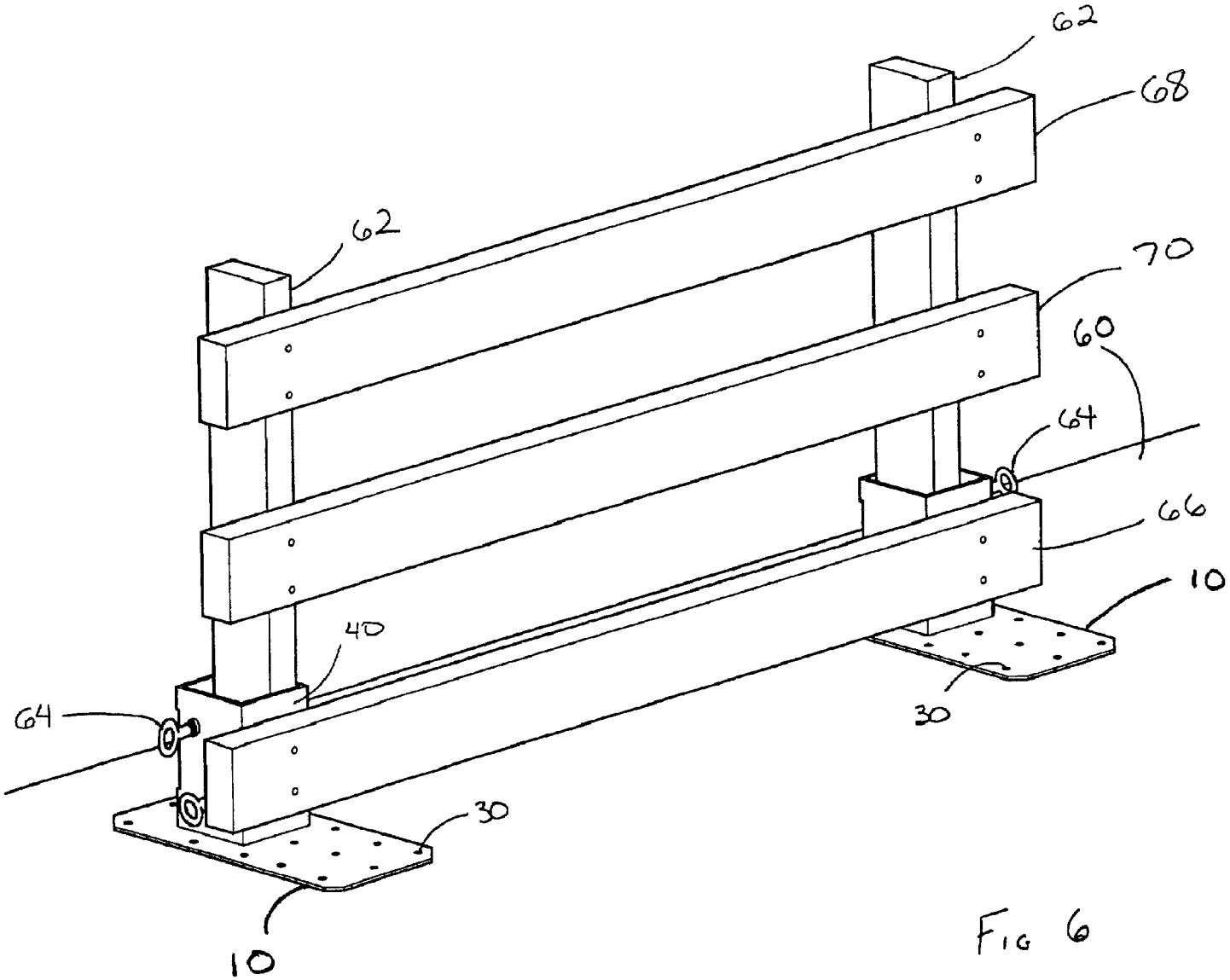
FIG. 6 is a perspective view of a safety rail incorporating a pair of construction brackets in accordance with the present invention.

As will be apparent to those skilled in the art, there are a wide variety of applications for construction bracket 10 in the construction industry. One such use is in the erection of safety rails. As shown in FIG. 6, construction bracket 10 is attached to a floor (or subfloor) 60 by driving nails or screws through securement apertures 30. Construction bracket 10 is mounted such that front face 40 faces inwardly towards the rest of the floor. A wooden vertical post 62 (for example a 2"×4", a 4"×4", or two 2"×4" wooden members) is placed within support column 22 and rests on floor 60 below such that it stands vertically. One or more eye bolts 64 may then be threaded into tightening apertures 48 to press vertical post 62 into support column 22 and to thus keep it steady and vertical. A wooden toe board 66 (a 2"×4" for example) is placed horizontally along floor 60 and nailed to the vertical post through one of lateral apertures 46. Toe board 66 may rest on the upper surface of base plate 20. A horizontally mounted wooden fence railing 68 and a midrail 70 may also be attached to the vertical post above the bracket. A series of vertical posts 62 mounted in further construction brackets 10 would allow for the creation of a safety fence along the edge of a floor where no wall has yet been constructed. The safety fence so constructed will help prevent persons from falling off the edge of a floor. The toe board will help prevent objects (such as tools, nails etc.) from being accidentally knocked off the edge of the floor, potentially injuring persons below.

If construction bracket 10 is attached to the floor such that one of side faces 44 faces towards the rest of the floor, the wooden kick board could be attached to the vertical post by driving a nail or screw through slot 50 on one of side faces 44. The advantage to using this configuration is that it would allow the user to loosen the eye bolts and lift the fence structure out of bracket 10. This would be useful in situations where the fence structure obstructed an area where work is required. The fence structure would remain intact and would be available for reinsertion into construction brackets 10.

Figure 7:
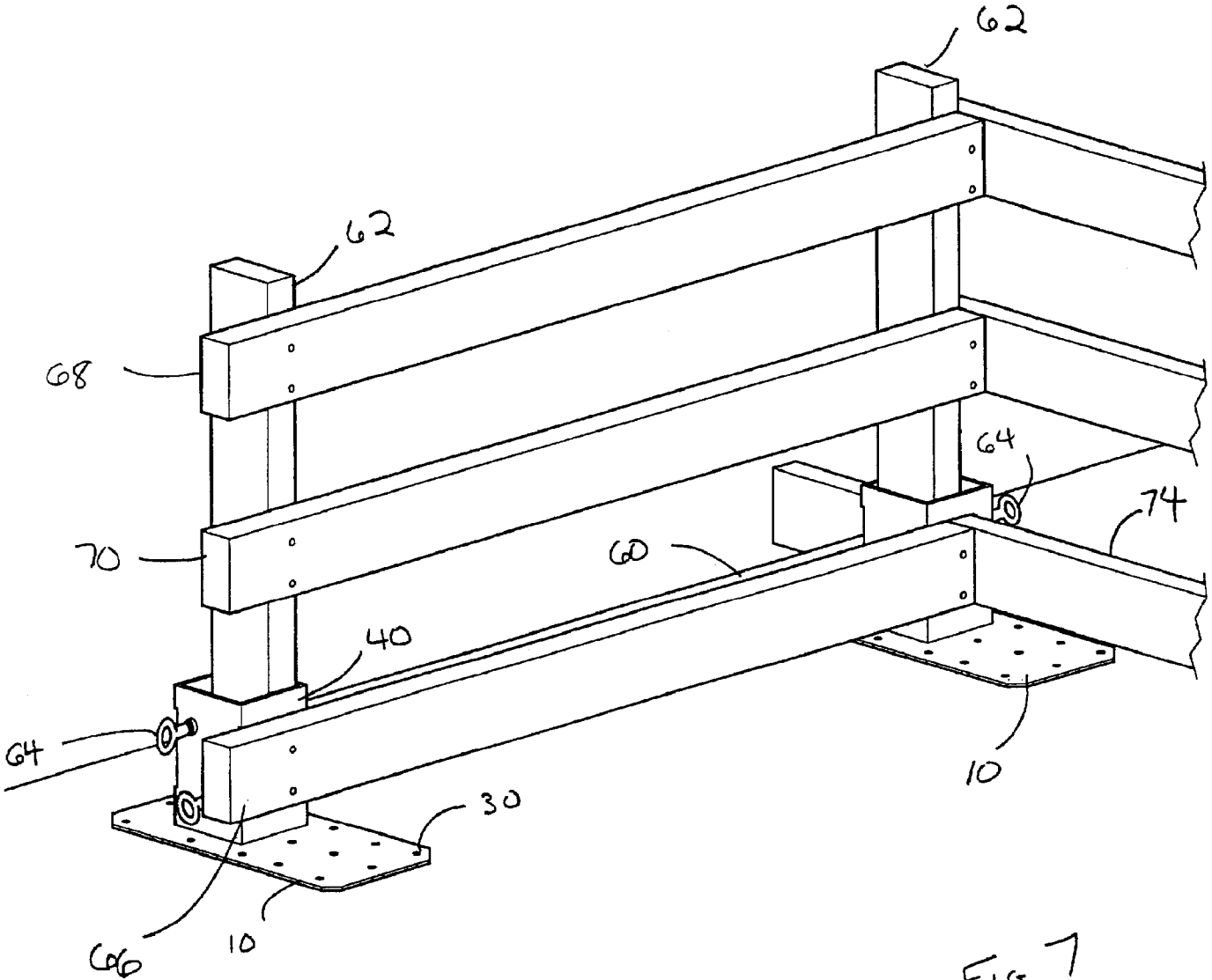
FIG. 7 is a perspective view of a safety rail incorporating a pair of construction brackets in accordance with the present invention, one of which is at the corner of the safety rail.

In a further safety fence application, as shown in FIG. 7, an additional horizontally mounted member 74 may be inserted through lateral aperture 46. Both horizontal member 74 and vertical post 62 would be mounted within support column 22. The eye bolt would press horizontal member 74 into vertical post 62, which in turn would be pressed against the inner surface of support column 22. This additional horizontal member could be mounted at a right angle to toe board 66 to provide a second toe board in a perpendicular direction. In this manner, one of vertical posts 62 could serve as a corner post of a safety fence, with two fence portions extending at right angles to one another.

Figure 8:
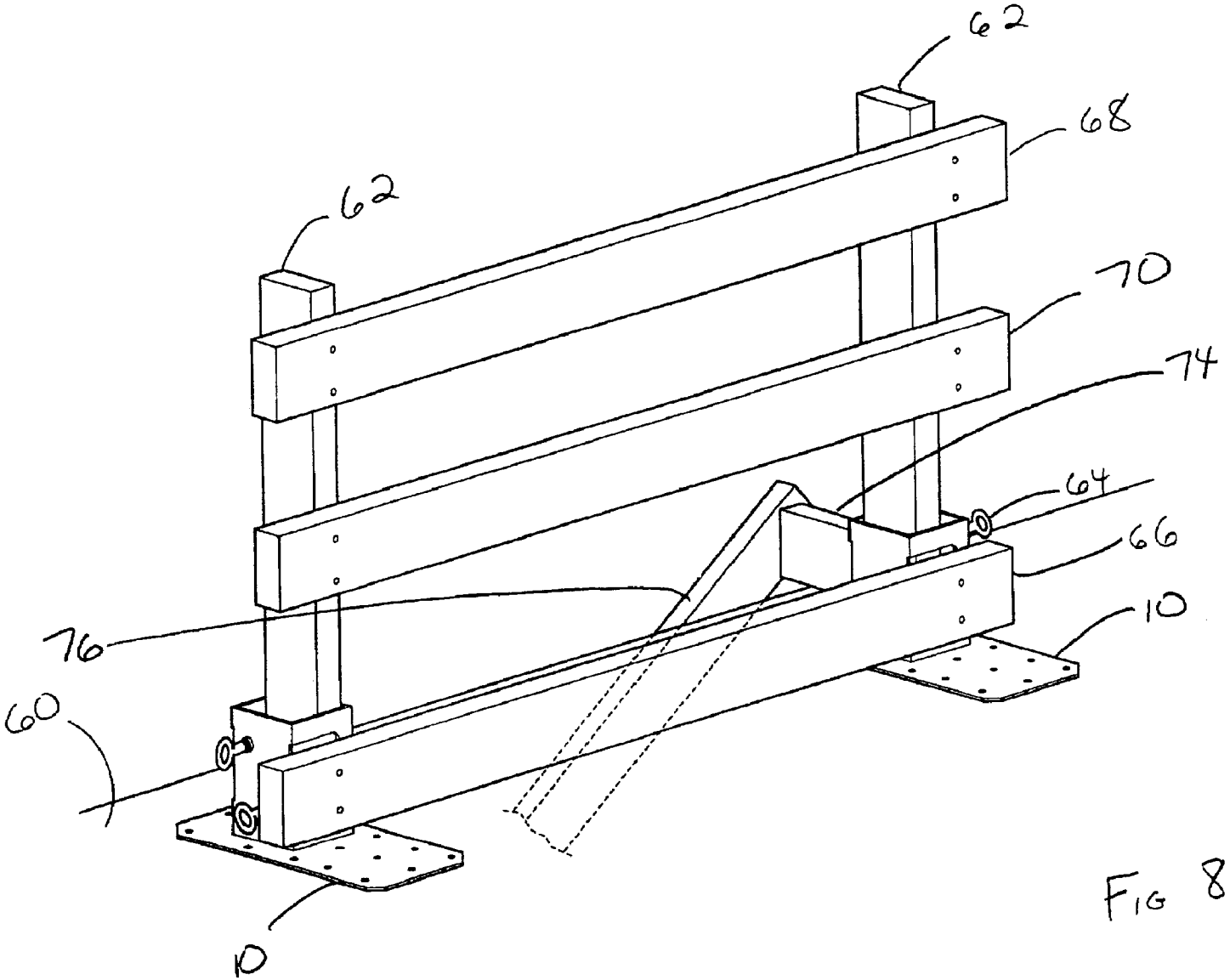
FIG. 8 is a perspective view of a safety rail incorporating a pair of construction brackets in accordance with the present invention with a horizontal member extending outwardly to support a temporary stair railing.

Optionally, as shown in FIG. 8, horizontal member 74 may extend instead outwardly of floor 60 to attach to a temporary stair railing 76 which extends downwardly. This configuration would be appropriate where construction bracket 10 is mounted near the top corner of a set of stairs.

Figure 9:
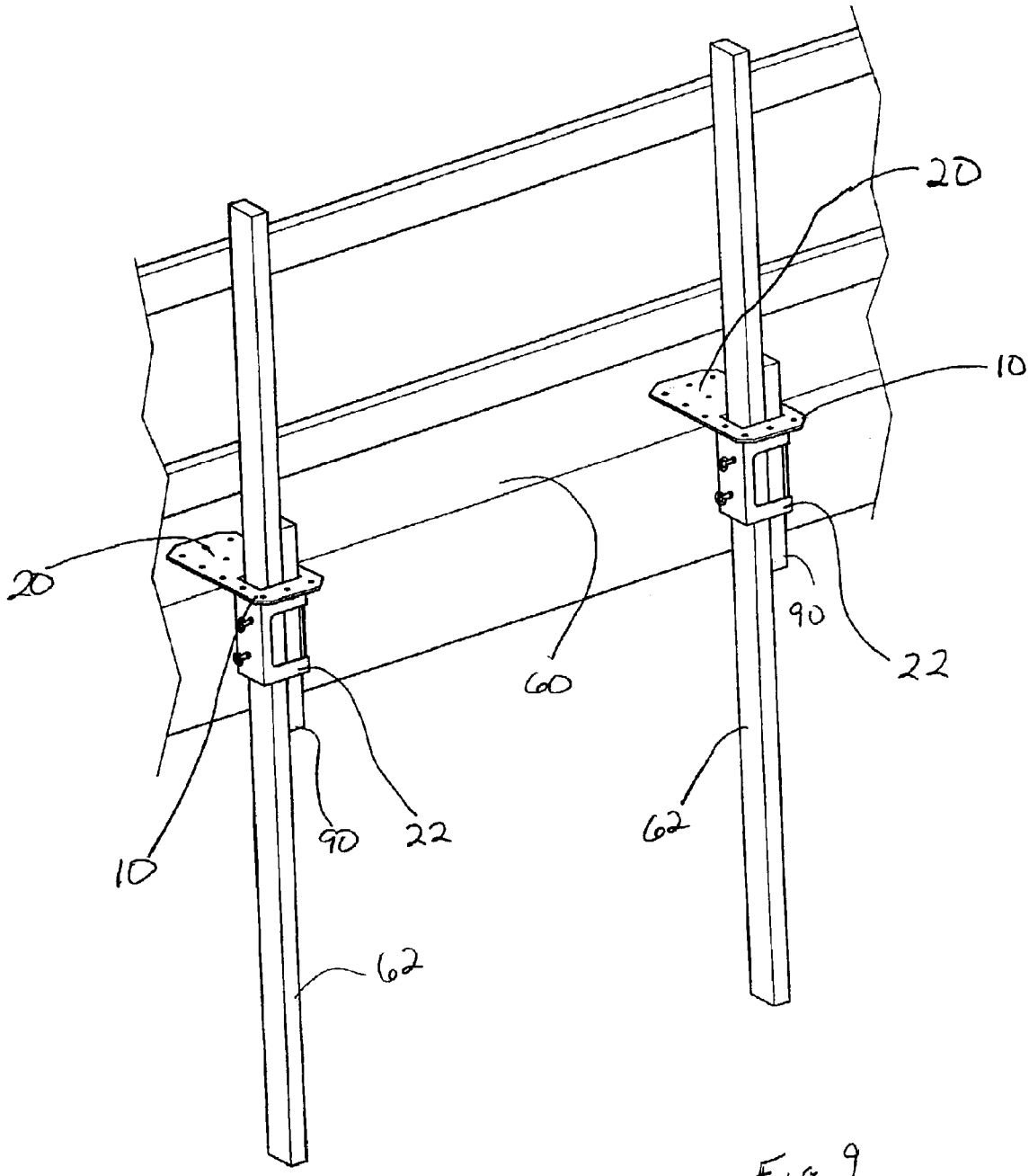
FIG. 9 is a perspective view of a different safety rail incorporating a pair of construction brackets in accordance with the present invention.

In another application, as shown in FIG. 9, construction bracket 10 may be mounted on the edge of floor 60 such that support column 22 extends downwardly from base plate 20 past the edge of floor 60. Vertical post 62 can be mounted such that it extends above and below floor 60 as vertical post 62 would pass through columnar aperture 32. This would allow vertical post 62 to span two or more floors or levels. In this application, vertical posts 62 could serve as the vertical members of a safety rail above the floor to which the bracket is affixed. In addition, this configuration would allow construction workers to mount temporary vertical posts without cutting the length of the pieces of wood with which they are already working. Thus, after the temporary post is no longer required, the length of wood may be reused for other posts or in the actual construction of the building.

Figure 10:
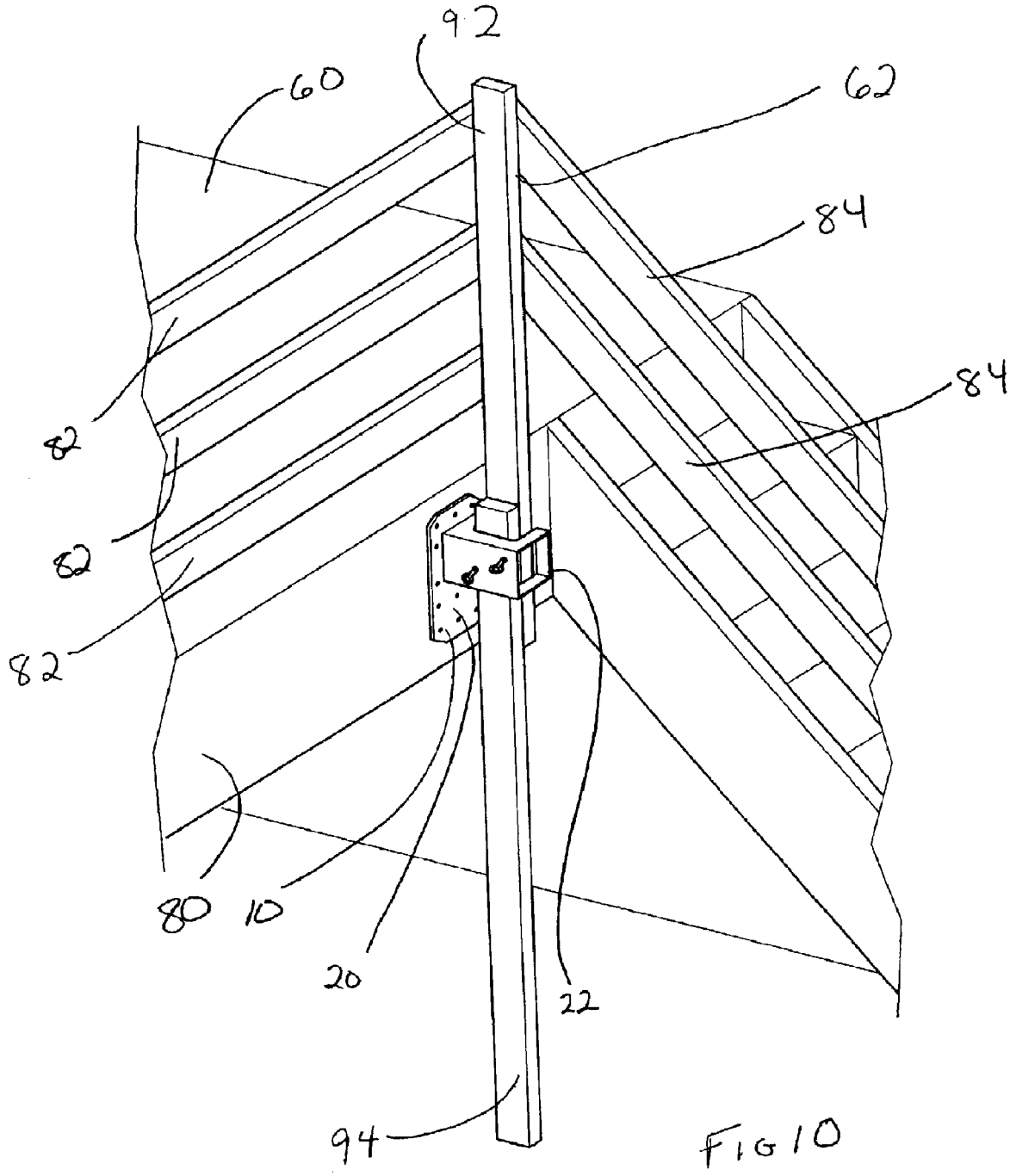
FIG. 10 is a perspective view of a safety rail incorporating a construction bracket in accordance with the present invention for supporting a vertical post which extends above and below a floor.

There are situations, however, where the installation of construction bracket 10 directly onto a floor may be inappropriate. For example, when a hardwood floor has been installed onto a subfloor, nailing or screwing construction bracket 10 into the floor would damage and/or mar the wood surface. However, if a safety rail still needs to be installed, construction bracket 10 could still be installed as shown in FIG. 10. Construction bracket 10 is mounted on a wall section or header 80 (which extends downwardly from the edge of floor 60), such that support column 22 extends outwardly from header 80. Vertical post 62 extends through lateral aperture 46 and is tightened in place by eye bolts 64. Vertical post 62, as shown in FIG. 10, can then be used to support a set of horizontal railings 82 for a safety fence and to support a set of stair railings 84. In this configuration, because lateral aperture 46 is spaced from base plate 20, vertical post 62 is spaced from the edge of floor 60. This is advantageous in situations where a nosing or border has been installed which extends past the edge of the subfloor. If vertical post is sufficiently spaced from the edge of floor 60, it will not touch the nosing.

FIGS. 9 and 10 show two different methods of extending vertical posts above and below the subfloor. In FIG. 9, a single vertical post 62 is long enough to serve as the vertical post of a railing above the floor, and to extend below to potentially become a part of other temporary structures. In FIG. 9, a second, shorter vertical member 90 is inserted into support column 22 adjacent to vertical post 62. While not required by the present invention, in some cases, a second length of wood inserted parallel and adjacent to a main post within support column 22 may help to stabilize the temporary structure. This is especially the case where the main post has a significantly smaller cross-sectional area than the cross-sectional area of support column 22. In FIG. 10, an upper post 92 and a lower post 94 are used to span the length of the upper and lower floors. Essentially, upper post 92 overlaps lower post 94 within construction bracket 10 to effectively create a vertical post which spans two levels.

Figure 11:
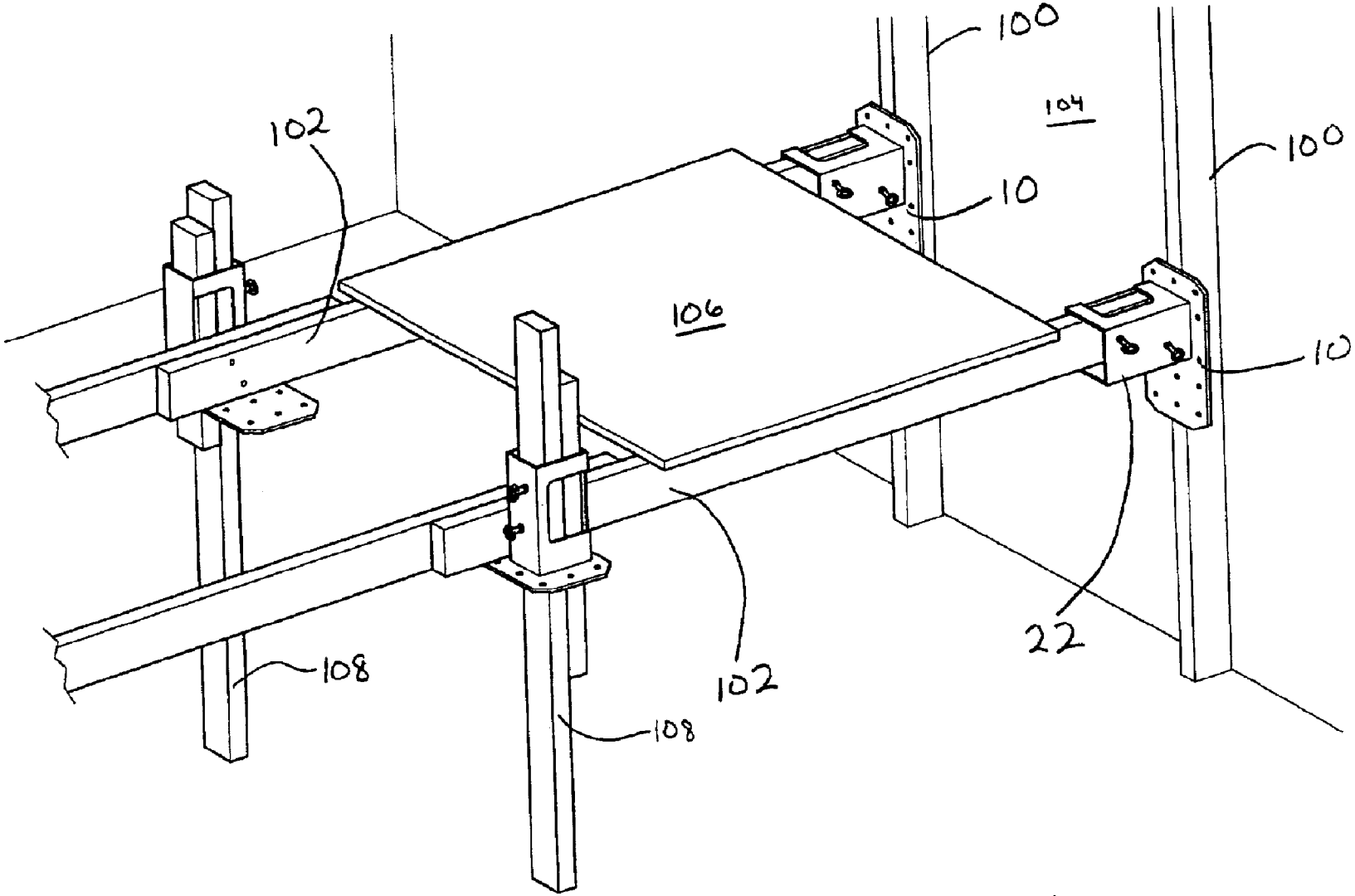
FIG. 11 is a perspective view of a temporary scaffolding incorporating construction brackets in accordance with the present invention.

Construction bracket 10 may even be used to assemble temporary scaffolding, as shown in FIG. 11. Two sets of two brackets may be mounted to wall braces 100 on opposite walls 104 (note that only one wall is shown in FIG. 11) such that each support column 22 extends horizontally away from the wall. Each opposed pair of brackets supports one horizontally extending scaffold support beam 102. A flat board 106 may then be placed across the two scaffold support beams to form the scaffold. If the scaffold needs extra support in the center of the beam, a vertical post 108 (optionally supported at its base by another construction bracket) may be used to mount an additional bracket 10 to support scaffold support beam 102 on base plate 20.

It will be obvious to those skilled in the art that construction bracket 10 can be used in a myriad of ways. Essentially, it can support a vertical post in the support column (when construction bracket 10 is positioned such that support column 22 extends vertically from base plate 20) and accommodate the attachment of beams perpendicular to the vertical post at around the same level as base plate 20. The perpendicular beams could be attached in a variety of ways. One method is by passing a beam horizontally through lateral aperture 46. Another method involves securing a beam to a vertical post in support column 22 by driving an attachment in the nature of a nail or screw through the beam into the vertical post via lateral aperture 46, tightening aperture 48, slot 50, secondary aperture 52 or lower central aperture 54.

Construction bracket 10 is preferably constructed from metal or plastic. Optionally, construction bracket 10 may be constructed all or partially from corrugated metal to improve strength and stiffness as well as to reduce costs.

To those skilled in the art, it is clear that the faces could be reoriented. Side faces 44 could be interchanged with front and rear faces 40 and 42. In addition, one of side faces 44 could be exchanged with one of front and rear faces 40 and 42. Such changes would alter the applications to which construction bracket 10 could be applied.

A variety of tighteners can be incorporated in the present design to secure a vertical post within support column 22. A preferred tightener shown in FIG. 5 is a pair of eye bolts 64 threaded into tightening apertures 48, when such apertures are threaded. The advantage to using eye-bolts is that they are easily tightened and loosened as required. However, hexagonal head bolts or other threaded bolts may also be used. In addition, the bolts may be provided with a plate at the end thereof to provide a larger surface for pressing against the construction member.

It is also possible to use screws or nails as tighteners. Screws or nails may be driven into wooden beams within support column 22 through tightening apertures 48 or secondary apertures 52, provided that the head of the screw or nail is larger than the aperture. Preferably, if screws or nails are to be used, they should be used in apertures in both of side faces 44. If a sufficient number of screws or nails used, the temporary structure should remain stable.

A further tightener which could be used in the present invention involves a pressure lever which is passed through a tightening aperture. The user could activate the outer end of the lever, causing the inner end to press against the wooden post. The lever could be lockable to maintain the force on the post within the support column. Another possible tightener involves more significant design changes to bracket 10. In this version, there is a slight gap between two adjacent faces of support column 22 and protrusions extend outward from each of the faces parallel to one another. A bolt is passed through apertures in the protrusions. When the bolt is tightened, the corners of the two adjacent faces are brought closer together, thus reducing the cross-sectional area of the support column. If the vertical post is sized such that it is almost the same cross-sectional area and shape of the column, the tightening of the bolt with act to squeeze the faces of the column about the post.

In terms of sizing, in one preferred configuration, columnar aperture 32 can accommodate a 4"×4" piece of wood or two 2"×4" pieces of wood, while lateral aperture can receive a 2"×4" piece of wood. Clearly, configurations having other sizes may be used.

In yet another variation of the preferred embodiment, the inner surfaces of the faces of support column 22 are provided with protrusions which could press into the beams within column member 22 as a tightener is pressed against the beam. Such protrusions could be elongated, pointed or any other appropriate shape Other modifications and alterations may be used in the design and manufacture of the apparatus of the present invention without departing from the spirit and scope of the accompanying claims.

Throughout this specification and the claims which follow, the directions "up" and "down" are used. These directions shall be interpreted in accordance with the orientation shown in FIG. 1, unless the context requires otherwise, such that support column 22 extends upwardly from base plate 20.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

Moreover, the word "substantially" when used with an adjective or adverb is intended to enhance the scope of the particular characteristic; e.g., substantially vertical is intended to mean perpendicular to a horizontal orientation, or nearly so, and/or exhibiting characteristics associated with a general vertical element or orientation.

What is claimed is:

1. A bracket comprising:

a support plate having a plurality of securement apertures, wherein a bottom surface of the support plate is adapted to be secured to a flat surface by screws or nails being driven through the securement apertures;

a substantially hollow column member having four side walls extending upwardly from said support plate, said column member sized to receive at least a first elongated construction member of at least a standard wooden two by four size mounted substantially perpendicular to the support plate, wherein a central axis extending down the center of the hollow column is laterally displaced from a centerpoint of the support plate to provide a portion of the support plate extending from the column member having a top surface adapted to be secured to a flat surface by a screw or nail being driven through at least one of the securement apertures;

the column member being further provided with opposed lateral apertures sized for receiving at least a second construction member of at least a standard wooden two by four size, wherein the opposed lateral apertures are offset a greater distance from a first of said side walls than from an opposed second of said side walls, the lateral apertures constructed and arranged such that the second construction member can be mounted substantially parallel to the support plate by passing through said opposed lateral apertures and extending completely through said column member;

the column member being provided with at least one tightening aperture in a third of said side walls and at least one tightener, the tightening aperture and the tightener being constructed and arranged for removably securing the construction members to the column member when the construction members are mounted substantially parallel to the support plate or substantially perpendicular to the support plate; and an aperture in said support plate constructed and arranged so that the first construction member can pass completely through the hollow column member and the support plate when mounted substantially perpendicular to the support plate.

2. A bracket as claimed in claim 1, wherein said tightener is at least one threaded bolt and wherein said at least one tightening apertures are provided with internal threads for receiving said at least one threaded bolt.

3. A bracket as claimed in claim 1, wherein said column member is provided with at least one vertically extending slot.

4. A bracket as claimed in claim 1, wherein said column member has a generally rectilinear horizontal cross-section.

5. The bracket of claim 1, wherein the column member and the opposed lateral apertures are sized to receive at least one standard size wooden four by four post or two standard sized wooden two by four posts.

6. The temporary structure according to claim 1, wherein the top and bottom surfaces of the support plate are generally flat.

7. A temporary construction structure comprising:

at least one bracket comprising:

a support plate having a plurality of securement apertures and a bottom surface;

a substantially hollow column member having four side walls extending upwardly from said support plate, wherein a central axis extending down the center of the hollow column is laterally displaced from a centerpoint of the support plate to provide a portion of the support plate extending from the column member having top surface, wherein at least one of the top surface of the support plate and the bottom surface of the support plate is secured to a flat surface of a structure under construction by at least one nail or screw driven through at least one of the securing apertures;

the column member being provided with opposed lateral apertures offset a greater distance from a first of said side walls than from an opposed second of said sidewalls;

the column member being provided with at least one tightening aperture in a third of said side walls and at least one tightener; and an aperture in said support plate aligned with the hollow column member; and at least one construction member being held in place by the tightener; the at least one construction member having at least the size of a standard wooden two by four and being mounted within the hollow member in one of a first position and a second position; the first position being so that the at least one construction member extends all the way through the column member and the aperture of the support plate and is substantially perpendicular to the support plate; the second position being so that the construction member passes completely through the opposed lateral apertures and is substantially parallel to the support plate.

8. The temporary structure according to claim 7, further comprising at least a second construction member mounted in the other of said first position and second position.

9. The temporary structure according to claim 7, wherein the at least one construction member comprises a standard wooden four by four post.

10. The temporary structure according to claim 7, wherein the temporary structure comprises scaffolding.

11. The temporary structure according to claim 7, wherein the top and bottom surfaces of the support plate are generally flat.

* * * * *